US010393376B2

(12) United States Patent
Nagasaka

(10) Patent No.: US 10,393,376 B2
(45) Date of Patent: Aug. 27, 2019

(54) INDOOR INSTALLATION TYPE COMBUSTION APPARATUS

(71) Applicant: RINNAI CORPORATION, Nagoya-shi, Aichi (JP)

(72) Inventor: Toshimitsu Nagasaka, Nagoya (JP)

(73) Assignee: RINNAI CORPORATION, Aichi (JP)

( * ) Notice: Subject to any disclaimer, the term of this patent is extended or adjusted under 35 U.S.C. 154(b) by 253 days.

(21) Appl. No.: 15/615,904

(22) Filed: Jun. 7, 2017

(65) Prior Publication Data

US 2018/0010793 A1 Jan. 11, 2018

(30) Foreign Application Priority Data

Jul. 5, 2016 (JP) ..... 2016-133025

(51) Int. Cl.

| | |
|---|---|
| ***F23L 17/02*** | (2006.01) |
| ***F23L 1/00*** | (2006.01) |
| ***F24H 1/14*** | (2006.01) |
| *F28D 1/047* | (2006.01) |
| *F28D 1/053* | (2006.01) |
| *F28D 21/00* | (2006.01) |

(52) U.S. Cl.

CPC ..... *F23L 1/00* (2013.01); *F23L 17/02* (2013.01); *F24H 1/145* (2013.01); *F28D 1/0478* (2013.01); *F28D 1/05366* (2013.01); *F28D 2021/0024* (2013.01)

(58) Field of Classification Search

CPC ..... F23L 1/00
USPC ..... 126/80, 116 R, 110 R; 237/56
See application file for complete search history.

(56) References Cited

U.S. PATENT DOCUMENTS

| | | | | |
|---|---|---|---|---|
| 3,540,710 | A * | 11/1970 | Yamagishi | C21D 9/663 432/206 |
| 3,601,116 | A * | 8/1971 | Davis | F24F 1/00 126/110 AA |
| 3,974,784 | A * | 8/1976 | Greenberg | B01D 53/34 588/314 |
| 5,697,330 | A * | 12/1997 | Yetman | F24H 1/205 122/14.21 |
| 2007/0108306 | A1 * | 5/2007 | Ando | F24H 9/20 237/56 |

(Continued)

FOREIGN PATENT DOCUMENTS

JP 2015-183887 A 10/2015

*Primary Examiner* — Avinash A Savani
(74) *Attorney, Agent, or Firm* — Cermak Nakajima & McGowan LLP; Tomoko Nakajima

(57) ABSTRACT

An indoor installation type combustion apparatus includes an upper surface of the exterior case has formed therein: a cylindrical exhaust connection port which is in communication with an exhaust duct and which is connectable to an exhaust pipe; a first cylindrical air supply connection port which is connectable to an air supply pipe of double-pipe system containing therein the exhaust pipe and which encloses the exhaust connection port; and a second cylindrical air supply connection port which is connectable to an air supply pipe of twin-pipe system which is separate from, and independent of, the exhaust pipe, a low-cost apparatus is provided in which the air flowing in from whichever the first and the second air supply connection ports will be treated by one and the same supply-air filter. An air supply box which is in communication with both the first and the second air supply connection ports is disposed.

6 Claims, 5 Drawing Sheets

(56) References Cited

U.S. PATENT DOCUMENTS

2009/0314275 A1* 12/2009 Nishio ..... F24H 3/0488
126/116 A

* cited by examiner

INDOOR INSTALLATION TYPE COMBUSTION APPARATUS

BACKGROUND OF THE INVENTION

1. Technical Field

The present invention relates to an indoor installation type combustion apparatus having housed inside an exterior case: a burner; a combustion box for enclosing a combustion space of air-fuel mixture ejected from the burner; and an exhaust duct through which exhaust gas discharged from the combustion box flows. In this combustion apparatus, as an air supply pipe to supply air into the exterior case from outside, an arrangement has been made that use can be made of both an air supply pipe of double-pipe system in which an exhaust pipe is housed inside the air supply pipe, and an air supply pipe of twin-pipe system in which the air supply pipe is independent of, and separate from, the exhaust pipe.

2. Background Art

In this kind of indoor installation type combustion apparatus, an upper surface of the exterior case has formed therein: a cylindrical exhaust connection port which is in communication with an exhaust duct and which is connectable to an exhaust pipe; a first cylindrical air supply connection port which is connectable to an air supply pipe of double-pipe system and which encloses the exhaust connection port; and a second cylindrical air supply connection port which is connectable to an air supply pipe of twin-pipe system (see, for example, JP-A-2015-183887). In this arrangement, at the stage of delivery, each of the first and the second air supply connection ports is closed by respective lid members. In case the air supply pipe of double-pipe system is used, the air supply pipe is connected to the first air supply connection port in a state in which the lid member closing the first air supply connection port has been removed. On the other hand, in case the air supply pipe of twin-pipe system is used, the air supply pipe is connected to the second air supply connection port in a state in which the lid member closing the second air supply connection port has been removed By the way, since the air to be supplied through the air supply pipe will sometimes contain foreign matters, it is necessary to prevent the foreign matters from entering the exterior case. As a solution, at that outlet portion of each of the first and the second air supply connection ports which is in communication with the inside of the exterior case, a supply-air filter (i.e., a filter for filtering air to be supplied) is respectively mounted. According to this solution, however, two kinds of supply-air filters are necessary for the first air supply connection port and for the second air supply connection port, thereby resulting in an increase in cost.

SUMMARY

Problems that the Invention is to Solve

In view of the above points, this invention has a problem of providing an indoor installation type combustion apparatus in which, from whichever the first and the second air supply connection ports the air may come in, the incoming air can be treated by one and the same supply-air filter.

Means for Solving the Problems

In order to solve the above problem, this invention is an indoor installation type combustion apparatus having housed inside an exterior case: a burner; a combustion box for enclosing a combustion space of air-fuel mixture ejected from the burner; and an exhaust duct through which exhaust gas discharged from the combustion box flows. An upper surface of the exterior case has formed therein: a cylindrical exhaust connection port which is in communication with the exhaust duct and which is connectable to an exhaust pipe; a first cylindrical air supply connection port which is connectable to an air supply pipe of double-pipe system containing therein the exhaust pipe and which encloses the exhaust connection port; and a second cylindrical air supply connection port which is connectable to an air supply pipe of twin-pipe system which is separate from, and independent of, the exhaust pipe. In the above-mentioned combustion apparatus, an air supply box which is in communication with both the first and the second air supply connection ports is disposed; an outlet opening is formed at one place of the air supply box so that the air flowing in from an arbitrary air supply connection port between the first and the second air supply connection ports is discharged into an inner space of the exterior case; and a supply-air filter to collect foreign matters in the air is mounted in the outlet opening.

According to this invention, even in case the air comes in from either the first or the second air supply connection ports, foreign matters in the air will be collected by one and the same supply-air filter that is mounted in the outlet opening of the air supply box. Therefore, it is not necessary to prepare two kinds of supply-air filters for the first air supply connection port and for the second air supply connection port, respectively. The reduction in cost can be attained.

Further, in this invention, preferably, a part of the air supply box is constituted by a part of the exterior case. According to this arrangement, a part of the exterior case is arranged to serve a dual purpose also as the constituent member of the air supply box. This will lead to the reduction in weight and in the cost of the combustion apparatus.

By the way, in this invention, from whichever of the first and the second air supply connection ports does the air flows in, the position of air supply to the exterior case will be the outlet opening of the air supply box, and will not subsequently be changed thereafter. By disposing a constituent part giving rise to heat generation during operation of the combustion apparatus (heat-generating part) in a position exposed to the air flowing out of the outlet opening, the heat-generating part can advantageously be cooled efficiently.

Generally, the exterior case is constituted by: a box-type case main body which is left open on the front surface; and a front cover which is mounted on the front surface of the case main body. In this arrangement, preferably, the supply-air filter is mounted and dismounted in a manner freely inserting into, and drawing out of, the outlet opening from a front side of the air supply box. Preferably, the front cover of the exterior case has a filter presser portion which is positioned in front of the front end of the supply-air filter to prevent the supply-air filter from getting pulled out of position. According to this arrangement, screws and the like to fix in position the supply-air filter are not necessary. The ease with which the supply-air filter is mounted or dismounted can be improved and the cost can be reduced.

Further, there is a case in which the rain water penetrated into the air supply pipe may sometimes drop from that air supply connection port, out of the first and the second air supply connection ports, to which is connected the air supply pipe. Therefore, in this invention, preferably, the outlet opening is formed in that portion of the bottom plate of the air supply box which is away from just below (or right below) the first and the second air supply connection ports. According to this arrangement, even if rain water may drop from one of the first and the second air supply connection ports, this rain water can be prevented from dropping into the outlet opening.

In this case, by inclining the bottom plate of the air supply box toward at least one of the front-to-back direction and the left-to-right direction so that the outlet opening side becomes higher, the rain water that may have dropped from the air supply connection port to which the air supply pipe is connected can advantageously be prevented from penetrating along the bottom plate into the outlet opening. Further, a downwardly recessed concave groove or an upwardly projected ridge is advantageously disposed in the bottom plate of the air supply box in a manner to be positioned between the outlet opening and just below the air supply connection port that is adjacent to the outlet opening out of just below the first and the second air supply connection ports. The recessed concave groove or the projected ridge is extended along the direction of inclination in the bottom plate. According to the above arrangement, the rain water can surely be prevented from penetrating into the outlet opening.

PREFERRED EMBODIMENTS FOR CARRYING OUT THE INVENTION

Figure 1:
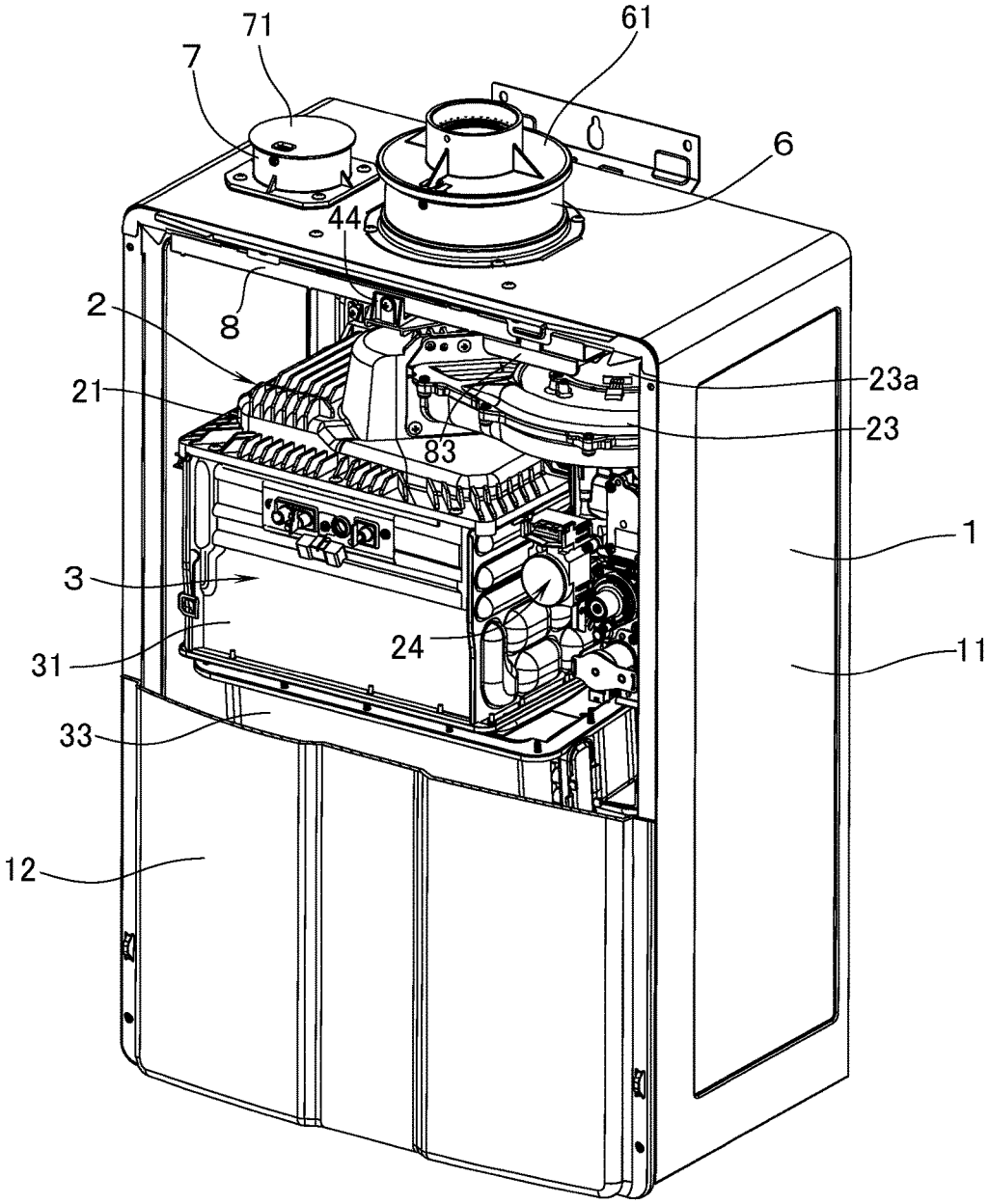
FIG. 1 is a perspective view of a combustion apparatus of an embodiment of this invention.
Figure 2:
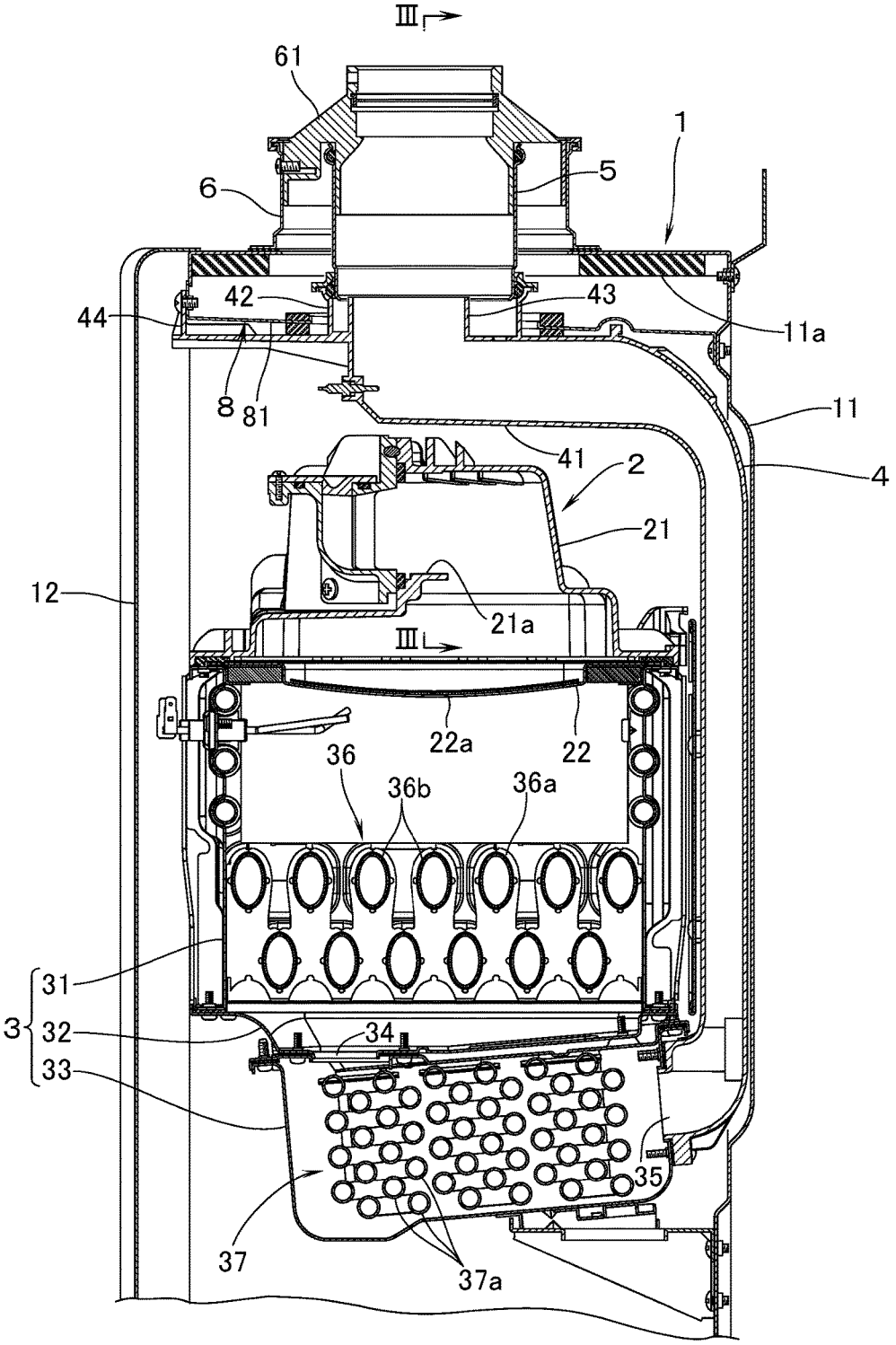
FIG. 2 is a cut-away sectional view of an essential portion of the combustion apparatus of the embodiment.

With reference to FIGS. 1 and 2, an indoor installation type combustion apparatus according to an embodiment of this invention has housed, inside an exterior case 1: a burner 2 for ejecting downward air-fuel mixture; a combustion box 3, under the burner 2, for enclosing a combustion space of air-fuel mixture ejected from the burner 2; and an exhaust duct 4 through which exhaust gas discharged from the combustion box 3 flows. The exterior case 1 is constituted by: a case main body 11 whose front surface is left open; and a front cover 12 which can be detachably attached to the front surface of the case main body 11.

The burner 2 is provided with: a box-shaped burner body 21 which opens downward; and a combustion plate 22 which covers the downward-looking opening surface of the burner body 21. On an upper portion of the burner body 21, there is formed an inlet port 21*a* to which a fan 23 is connected. The fan 23 is connected to the downstream side of a premixing device 24. The premixing device 24 generates air-fuel mixture by mixing fuel gas with air that is supplied from the air supply pipe, to be described later, into the exterior case 1. Then, the air-fuel mixture from the premixing device 24 is supplied through the fan 23 into the burner body 21. This air-fuel mixture is ejected downward from an air-fuel mixture ejection portion 22*a* which is provided in the combustion plate 22, thereby carrying out totally primary air combustion (combustion requiring no secondary air).

The combustion box 3 is constituted by: an upper box 31 whose upper end portion is fastened to the peripheral edge portion of the lower surface of the burner body 21 and also the upper and lower surfaces of the upper box 31 are left open; a flat and dish-shaped intermediate box 32 which is fastened to the lower end of the upper box 31; and a lower box 33 which has an upper plate portion to be fastened to the bottom plate portion of the intermediate box 32 and also both upper and lower surfaces of the lower box 33 are blocked. At the front part of the bottom plate portion of the intermediate box 32 and of the upper plate portion of the lower box 33, there is formed a vent hole 34 which brings into communication with each other the inner space of the intermediate box 32 and the inner space of the lower box 33. Further, at the rear of the lower box 33, there is formed an exhaust port 35. In this manner, the combustion gas is arranged to flow from inside the upper box 31 through the intermediate box 32, through the vent hole 34, through inside the lower box 33, and through the exhaust port 35 toward the exhaust duct 4.

Inside the upper box 31, there is disposed a main heat exchanger 36 of a fin and tube type which is made up of a multiplicity of heat-absorbing fins 36*a* and a plurality of heat absorbing pipes 36*b* that pass through the heat absorbing fins 36*a*. Further, inside the lower box 23, there is disposed a subsidiary heat exchanger 37 of latent-heat recovery type which is made up of a plurality of upper and lower heat-absorbing pipes 37*a* elongated in a front-to-back direction in a snaking manner. After the water has been heated in the subsidiary heat exchanger 37, the water is further heated in the main heat exchanger 36 so that hot water at a predetermined set temperature can be supplied to the hot-water supply terminal.

Figure 3:
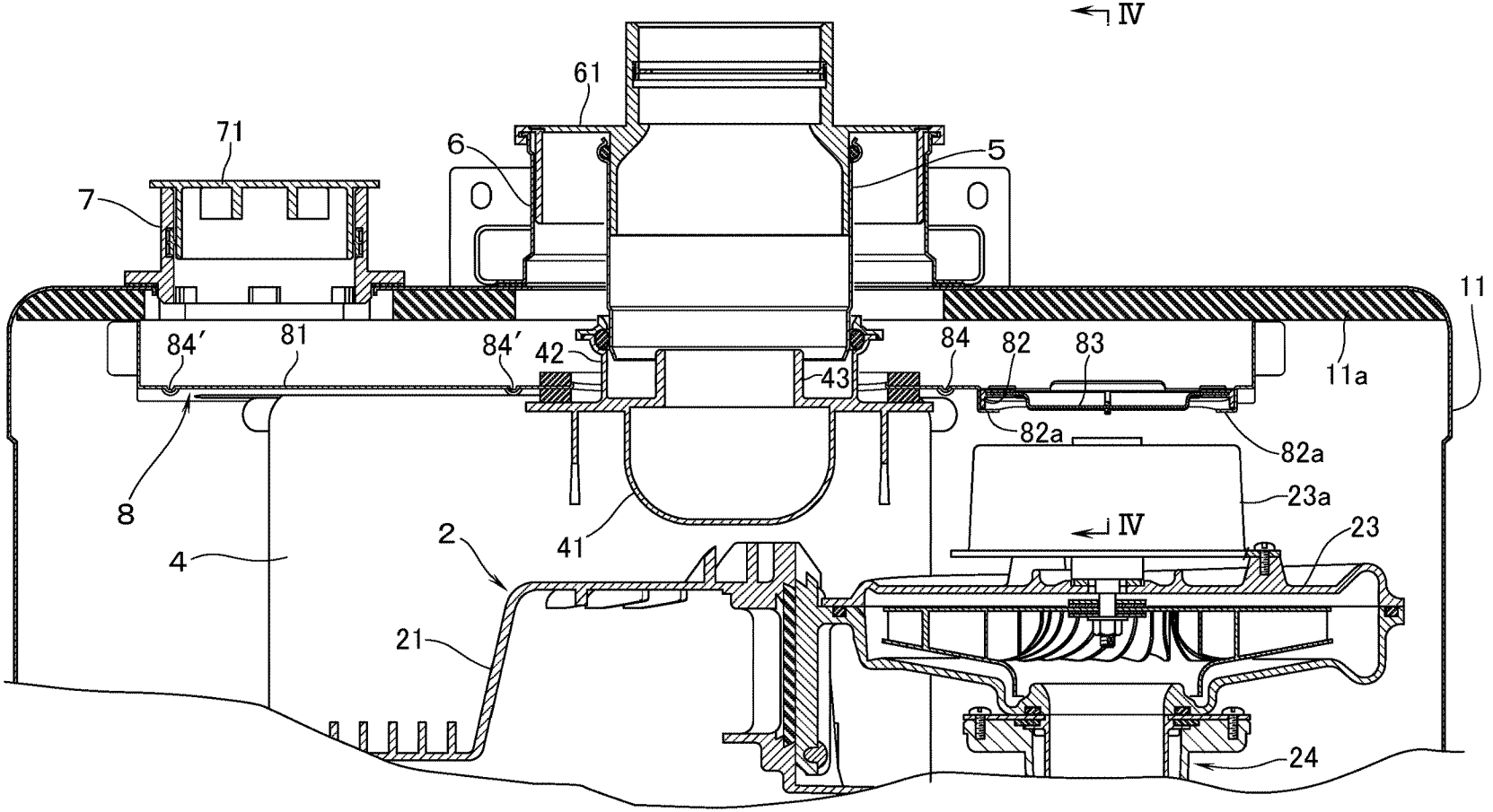
FIG. 3 is an enlarged sectional view cut away along the line III-III in FIG. 2.

With reference also to FIG. 3, an upper surface of the exterior case 1 has formed therein: in the central part of the right-and-left direction, a cylindrical exhaust connection port 5 which is connectable to an exhaust pipe (not illustrated) extending outdoors; and a first cylindrical air supply connection port 6 which is connectable to an air supply pipe (not illustrated) of double-pipe system having contained therein the exhaust pipe and which encloses the exhaust connection port 5. Further, in a position deviated to the left, there is formed a second cylindrical air supply connection port 7 which is connectable to an air supply pipe (not illustrated) of twin-pipe system, the air supply pipe being separate from, and independent of, the exhaust pipe. The exhaust connection port 5 is supported by the exhaust duct 4 in a state in which the lower end portion of the exhaust connection port 5 is fitted into a connection tube 42 that is vertically disposed on an upper surface of the bent portion 41 that is bent to the forward at the upper end of the exhaust duct 4. Further, the bent portion 41 is provided with an exhaust outlet 43 facing the exhaust connection port 5, at a position inside the connection tube 42. The exhaust connection port 5 is thus brought into communication with the exhaust duct 4 through the exhaust outlet 43. Still furthermore, each of the first and the second air supply connection ports 6, 7 is provided with respective lid members 61, 71 that close the air supply connection ports. In case the air supply pipe of double-pipe system is used, air supply pipe of double-pipe system is connected to the first air supply connection port 6 in a state of having removed the lid member 61. In case the air supply pipe of twin-pipe system is used, air supply pipe of twin-pipe system is connected to the second air supply connection port 7 in a state of having removed the lid member 71.

By the way, since the air that is supplied through the air supply pipe will sometimes contain foreign matters, it is necessary to prevent the foreign matters from entering the exterior case 1. In this case, it is conceivable to mount a filter on that outlet portion of each of the first and the second air supply connection ports 6, 7 which is in communication with the inside of the exterior case 1, in order to remove the foreign matters contained in the air. According to this arrangement, however, two kinds of supply-air filters are needed for use in the first air supply connection port 6 and for use in the second air supply connection port 7, thereby resulting in an increase in cost.

Figure 5:
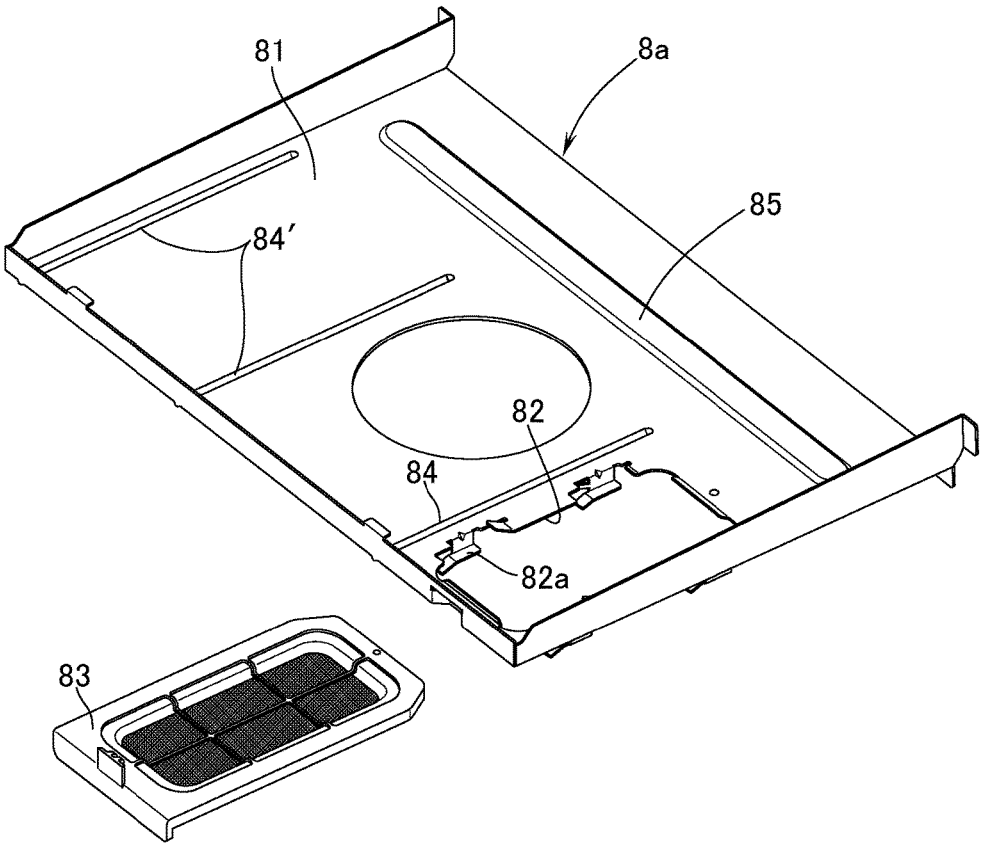
FIG. 5 is a perspective view of the box main body and the supply-air filter.

As a solution, in this embodiment, there is disposed an air supply box 8 which is in communication with both the first and the second air supply connection ports 6, 7, in a manner to lie along the upper surface of the exterior case 1. With reference also to FIG. 5, at one position, in particular, at the right front portion of the bottom plate 81 of the air supply box 8, there is formed an outlet opening 82 which discharges, into the inner space of the exterior case 1, the air flowing from an arbitrary air supply connection port between the first and the second air supply connection ports 6, 7. This outlet opening 82 has mounted thereon the supply-air filter 83 to collect the foreign matters in the air According to this arrangement, from whichever the first and the second air supply connection ports 6, 7 the air may flow in, the foreign matters can be collected by one and the same supply-air filter 83 that is mounted on the outlet opening 82 of the air supply box 8, and clean air can thus be supplied into the exterior case 1. Accordingly, it is not necessary to prepare two kinds of supply-air filters for uses in the first air supply connection port 6 and in the second air supply connection port 7, respectively. Cost reduction can thus be attained.

Further, from whichever the first and the second air supply connection ports 6, 7 the air may flow in, the position of air supply to the inside of the exterior case 1 is through the outlet opening 82 of the air supply box 8 and does not change from that position. Further, in this embodiment, in the position which is exposed to the air flowing out of the outlet opening 82, i.e., in the position just below the outlet opening 82, a motor 23*a* of the fan 23 that is a part giving rise to heat generation during operation is disposed. As a result, from whichever the first and the second air supply connection ports 6, 7 the air may flow in, the fan motor 23*a*, that is the heat-generating part, can be efficiently cooled.

Furthermore, the right front portion of the air supply box 8 in which the outlet opening 82 is formed in the bottom plate 81 is a portion which is away from the positions just below the first and the second air supply connection ports 6, 7. Therefore, even if the rain water that may have entered the air supply pipe drips from the air supply connection port, between the first and the second air supply connection ports 6, 7, to which the air supply pipe is connected, the rain water can be prevented from dropping into the outlet opening 82.

Further, the bottom plate 81 of the air supply box 8 is inclined in the front-to-back direction, i.e., such that the front side is up so that the side of the outlet opening 82 is raised in position. According to this arrangement, the rain water that may have dropped from the air supply connection port to which the air supply pipe is connected, can be prevented from entering the outlet opening 82 along the bottom plate 81. Further, according to this embodiment, the bottom plate 81 of the air supply box 8 is provided with a downwardly recessed groove 84 that is elongated along the direction of inclination of the bottom plate 81. The position of providing the recessed groove 84 is between the outlet opening 82 and just below the position of the air supply connection port that is adjacent to the outlet opening 82 between (i.e., out of) the positions just below the first and the second air supply connection ports 6, 7, i.e., just below the position of the first air supply connection port 6. According to this arrangement, even if the rain water that may have dropped from the first air supply connection port 6 is directed toward the side of the outlet opening 82, this rain water flows down along the recessed groove 84, so that the rain water can more surely be prevented from entering the outlet opening 82.

It is also possible to incline the bottom plate 81 of the air supply box 8 in the right-and-left direction so that the outlet opening 82 side can be raised in position, or else in the front-to-back direction and in the right-and-left direction so that the bottom plate 81 can be raised in position on the front side and also on the right side. What is important is that the bottom plate 81 of the air supply box 8 is inclined at least in one of the front-to-back direction and the left-to-right direction so that the side of the outlet opening 82 is raised in position. Furthermore, the bottom plate 81 of the air supply box 8 may be provided with an upwardly projected ridge, in place of the downwardly recessed groove 84. In this embodiment, a recessed groove 84' is disposed in a portion between the position just below the first air supply connection port 6 and the position just below the second air supply connection port 7 of the bottom plate 81, and another may be disposed on the left side of the position just below the second air supply connection port 7. However, these recessed grooves 84' may be omitted. Further, at the rear portion of the bottom plate 81 there is disposed an upwardly recessed clearance portion 85 in order to prevent the bent portion 41 of the upper end of the exhaust duct 4 from interfering with projections on the rear portion of the upper surface.

Further, in this embodiment, the air supply box 8 is constituted by covering, from the upper end and the rear end with the upper plate portion and the rear plate portion of the case main body 11, the box main body 8*a* having; the bottom plate 81; the front plate portion; and the side plate portion. In other words, the upper plate portion and the rear plate portion of the case main body 11 are made to serve the dual purpose also as the constituent members of the upper plate portion and the rear plate portion of the air supply box 8. Therefore, it is possible to reduce the weight and the cost of the combustion apparatus. By the way, on the lower surface of the upper plate portion of the case main body 11, there is mounted a packing 11*a*. Further, at the front end of the bent portion 41 on the upper end of the exhaust duct 4, there is disposed a fixing portion 44 which is fastened to the front plate portion of the air supply box 8.

Figure 4:
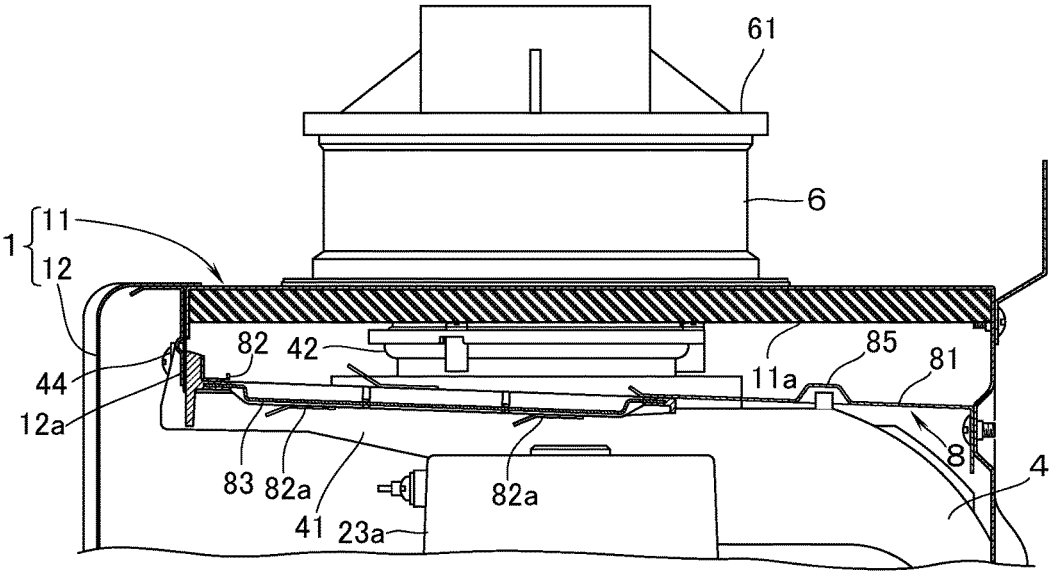
FIG. 4 is an enlarged sectional view of an essential portion as cut away along the line IV-IV in FIG. 3.

The supply-air filter 83 is mounted and dismounted in a manner freely inserting into, and drawing out from, the outlet opening 82 from a front side of the air supply box 8. In concrete, each of the side edge portions of the outlet opening 82 is provided with supporting portions 82*a* which support the lower surface of each of the right and left side edge portions of the supply-air filter 83. By means of these supporting portions 82*a*, the supply-air filter 83 is arranged to be supported in a manner freely inserting into, and drawing out from, a front side. In addition, as shown in FIG. 4, the front cover 12 of the exterior case is provided with a filter presser portion 12*a* which prevents, against the front end of the supply-air filter 83, the supply-air filter 83 from getting pulled out of position. According to this arrangement, screws and the like to fix the supply-air filter 83 in position are not required any longer. In this manner, the ease with which the supply-air filter 83 can be mounted or dismounted is improved and the costs are reduced.

Descriptions have so far been made of embodiments of this invention with reference to the accompanying drawings. This invention shall, however, be not limited to the above. For example, in this embodiment, the air-fuel mixture to be supplied from the premixing device 24 through the fan 23 is arranged to be subjected to totally primary air combustion. This invention can similarly be applied to a combustion apparatus using a burner of Bunsen combustion system requiring the secondary air. In addition, in the above-mentioned embodiment, the bottom plate 81 of the air supply box 8 has formed therein an outlet opening 82. However, provided that the height of the air supply box can be made larger, the outlet opening may alternatively be formed on one side plate on the left and right sides of the air supply box.

EXPLANATION OF MARKS

| | | | |
|---|---|---|---|
| 1 | exterior case | 12 | front cover |
| 12a | filter presser portion | 2 | burner |
| 3 | combustion box | 4 | exhaust duct |
| 5 | cylindrical exhaust connection port | | |
| 6 | first cylindrical air supply connection port | | |
| 7 | second cylindrical air supply connection port | | |
| 8 | air supply box | 81 | bottom plate |
| 82 | outlet opening | | |
| 83 | supply-air filter (i.e., filter for filtering air to be supplied) | | |
| 84 | recessed groove | | |

What is claimed is:

1. An indoor installation type combustion apparatus having housed inside an exterior case: a burner;

a combustion box for enclosing a combustion space of air-fuel mixture ejected from the burner; and an exhaust duct through which exhaust gas discharged from the combustion box flows, an upper surface of the exterior case having formed therein:

a cylindrical exhaust connection port which is in communication with the exhaust duct and which is connectable to an exhaust pipe;

a first cylindrical air supply connection port which is connectable to an air supply pipe of double-pipe system containing therein the exhaust pipe and which encloses the exhaust connection port; and a second cylindrical air supply connection port which is connectable to an air supply pipe of twin-pipe system which is separate from, and independent of, the exhaust pipe, wherein:

an air supply box which is in communication with both the first and the second air supply connection ports is disposed, an outlet opening is formed at one place of the air supply box so that the air flowing in from an arbitrary air supply connection port between the first and the second air supply connection ports is discharged into an inner space of the exterior case, wherein a supply-air filter to collect foreign matters in the air is mounted in the outlet opening, and wherein a part of the air supply box is constituted by a part of the exterior case.

2. An indoor installation type combustion apparatus having housed inside an exterior case:

a burner:

a combustion box for enclosing a combustion space of air-fuel mixture ejected from the burner; and an exhaust duct through which exhaust gas discharged from the combustion box flows, an upper surface of the exterior case having formed therein:

a cylindrical exhaust connection port which is in communication with the exhaust duct and which is connectable to an exhaust pipe;

a first cylindrical air supply connection port which is connectable to an air supply pipe of double-pipe system containing therein the exhaust pipe and which encloses the exhaust connection port; and a second cylindrical air supply connection port which is connectable to an air supply pipe of twin-pipe system which is separate from, and independent of, the exhaust pipe, wherein:

an air supply box which is in communication with both the first and the second air supply connection ports is disposed, an outlet opening is formed at one place of the air supply box so that the air flowing in from an arbitrary air supply connection port between the first and the second air supply connection ports is discharged into an inner space of the exterior case, wherein a supply-air filter to collect foreign matters in the air is mounted in the outlet opening, and wherein a constituent part giving rise to heat generation during operation is disposed in a position exposed to the air flowing out of the outlet opening.

3. An indoor installation type combustion apparatus having housed inside an exterior case:

a burner;

a combustion box for enclosing a combustion space of air-fuel mixture ejected from the burner; and an exhaust duct through which exhaust gas discharged from the combustion box flows, an upper surface of the exterior case having formed therein:

a cylindrical exhaust connection port which is in communication with the exhaust duct and which is connectable to an exhaust pipe;

a first cylindrical air supply connection port which is connectable to an air supply pipe of double-pipe system containing therein the exhaust pipe and which encloses the exhaust connection port; and a second cylindrical air supply connection port which is connectable to an air supply pipe of twin-pipe system which is separate from, and independent of, the exhaust pipe, wherein:

an air supply box which is in communication with both the first and the second air supply connection ports is disposed, an outlet opening is formed at one place of the air supply box so that the air flowing in from an arbitrary air supply connection port between the first and the second air supply connection ports is discharged into an inner space of the exterior case, wherein a supply-air filter to collect foreign matters in the air is mounted in the outlet opening, and in which the exterior case is constituted by: a box-type case main body which is left open on the front surface; and a front cover which is mounted on the front surface of the case main body, wherein the supply-air filter is mounted and dismounted in a manner freely inserting into, and drawing out of, the outlet opening from a front side of the air supply box, and wherein the front cover of the exterior case has a filter presser portion which is positioned in front of the front end of the supply-air filter to prevent the supply-air filter from getting pulled out of position.

4. An indoor installation type combustion apparatus having housed inside an exterior case:

a burner:

a combustion box for enclosing a combustion space of air-fuel mixture ejected from the burner; and an exhaust duct through which exhaust gas discharged from the combustion box flows, an upper surface of the exterior case having formed therein:

a cylindrical exhaust connection port which is in communication with the exhaust duct and which is connectable to an exhaust pipe;

a first cylindrical air supply connection port which is connectable to an air supply pipe of double-pipe system containing therein the exhaust pipe and which encloses the exhaust connection port; and a second cylindrical air supply connection port which is connectable to an air supply pipe of twin-pipe system which is separate from, and independent of, the exhaust pipe, wherein:

an air supply box which is in communication with both the first and the second air supply connection ports is disposed, an outlet opening is formed at one place of the air supply box so that the air flowing in from an arbitrary air supply connection port between the first and the second air supply connection ports is discharged into an inner space of the exterior case, wherein a supply-air filter to collect foreign matters in the air is mounted in the outlet opening, and wherein the outlet opening is formed in that portion of the bottom plate of the air supply box which is away from just below the first and the second air supply connection ports.

5. The indoor installation type combustion apparatus according to claim 4, wherein the bottom plate of the air supply box is inclined toward at least one of the front-to-back direction and the left-and-right direction so that the outlet opening side becomes higher in position.

6. The indoor installation type combustion apparatus according to claim 5, wherein a downwardly recessed concave groove or an upwardly projected ridge is disposed in the bottom plate of the air supply box in a manner to be positioned between the outlet opening and just below the air supply connection port that is adjacent to the outlet opening out of just below the first and the second air supply connection ports, the recessed concave groove or the projected ridge being extended along the direction of inclination in the bottom plate.

* * * * *